US009155971B1

(12) United States Patent
Trowbridge

(10) Patent No.: US 9,155,971 B1
(45) Date of Patent: Oct. 13, 2015

(54) SELECTIVE ILLUMINATION OF PHYSICAL SCENERY IN AMUSEMENT PARK RIDES

(71) Applicant: DISNEY ENTERPRISES, INC., Burbank, CA (US)

(72) Inventor: Scott Trowbridge, La Canada, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 16 days.

(21) Appl. No.: 14/288,535

(22) Filed: May 28, 2014

(51) Int. Cl.
*A63G 31/02* (2006.01)
*A63G 31/00* (2006.01)

(52) U.S. Cl.
CPC ..... *A63G 31/02* (2013.01)

(58) Field of Classification Search
CPC ..... A63G 1/00; A63G 1/34; A63G 31/00; A63G 31/16; G02B 27/00; G02B 27/22; H04N 13/00; H04N 11/02; H04N 5/04
USPC ..... 472/43, 59–61, 130; 434/29, 55
See application file for complete search history.

(56) References Cited

U.S. PATENT DOCUMENTS

| | | | | |
|---|---|---|---|---|
| 7,905,790 | B2 * | 3/2011 | Schnuckle | 472/43 |
| 2009/0251531 | A1 * | 10/2009 | Marshall et al. | 348/42 |
| 2011/0157555 | A1 * | 6/2011 | Mashitani et al. | 353/7 |
| 2013/0003020 | A1 * | 1/2013 | Koehler et al. | 353/7 |

* cited by examiner

*Primary Examiner* — Kien Nguyen
(74) *Attorney, Agent, or Firm* — Marsh Fischmann & Breyfogle LLP; Kent A. Lembke

(57) ABSTRACT

A selective illumination system for use with amusement park rides and other attractions. The system includes a first light source illuminating a first set of items in a physical set and also includes a second light source illuminating a second set of items in the physical set. The system further includes a first set of optical filters operating in time synchronization with the first light source to pass light from the illuminated first set of items and also includes a second set of optical filters operating in time synchronization with the second light source to pass light from the illuminated first set of items. The optical filters of the first and second sets may be shutter glasses or other filters that are operated at high rates to selectively pass received light, and the first and second light sources are operated in a time multiplexed manner synchronized with the optical filters.

20 Claims, 4 Drawing Sheets

SELECTIVE ILLUMINATION OF PHYSICAL SCENERY IN AMUSEMENT PARK RIDES

BACKGROUND

1. Field of the Description

The present invention relates, in general, to amusement or theme park rides (often simply called "rides" herein) and illumination of the set or physical scenery surrounding or nearby the ride path, and, more particularly, to systems for selectively illuminating physical scenery in rides so as to provide differing sets of passengers on the rides differing ride experiences including visual experiences that are unique to each of the sets of passengers (even when within a single ride vehicle).

2. Relevant Background

Amusement and theme parks remain extremely popular with many thousands of people visiting these parks every year. Visitors experience a variety of attractions including rides, walk through attractions, shows, and the like. To encourage enjoyment and attendance, it can be beneficial for an attraction to provide variability in experiences so that a visitor can have multiple difference experiences on the same attraction.

For example, water-based rides may vary with each ride with the water spraying or soaking riders in a relatively random manner. In other cases, a ride experience may vary based on the rider's location in a car or train of vehicles (e.g., are you in the lead car of a roller coaster or toward the rear of the coaster train?). However, many attractions have elaborate and detailed physical scenery that has not been designed to readily change in a manner that supports experience variability.

Another approach to increasing enjoyment is to personalize the experience. For example, a ride might be operated to identify a rider, such as one having their birthday, and to provide the identified rider a personalized experience such as by announcing their name as they pass a location and so on. Similar to personalization, a ride may be operated to provide "group appropriateness" such as by attempting to give younger riders a youth-oriented experience while providing teenagers and adults a more mature experience. However, it has often been difficult for ride designers to provide differing experiences within a single ride. For example, it is a difficult challenge to design a ride so as to increase or decrease thrill or to vary imagery displayed to the riders (e.g., show bad guys or scary images to teenagers while showing good guys or much less scary images to children) as they move along a track through a themed ride. In addition to the difficult task of changing configuration of the elaborate scenery, segregating the audience is difficult and can interfere with families and friends enjoying an attraction together.

Hence, there remains a need for new ride or attraction designs or systems that facilitate personalization and selective variance of the ride or attraction experience. Preferably, such designs and/or systems are useful with existing rides and attractions as well as with completely new rides or experiences.

SUMMARY

The inventor recognized that it is relatively easy to provide different experiences to only one participant or viewer at a time, but personalization and/or variability of a ride or attraction experience becomes much more difficult when providing the experience to a large group of people such as to riders on a tracked ride or an omnimover ride. Specifically, when a group of people all view a physical scene such as a stage, a diorama, a sculpture, a painting, scenery along a ride track, or the like, they all expect to see the same thing. Since they are all viewing light reflected from a common source there typically is only slight variations based on an individual's viewing angle, but, for the most part, each person in the group or audience sees the same thing, e.g., the same set provided along a ride track.

The inventor further recognized that rides (or attractions with those terms being used interchangeably herein) may be modified to include a lighting system that is designed to selectively illuminate portions of the surrounding set (differing display items) along a ride path (or adjacent a ride track) so that two or more sets or groups of ride passengers (e.g., viewers of displayed items) each view different portions of the set. For example, the display system may include shutter glasses (or other selectively controlled eyewear such as color filter glasses) that are synchronized by a controller with lighting (such as spotlights, fill lights, backlights, and the like along the ride path/track) that is high-frequency controlled by the same or a different display system controller. The display system makes use of time multiplexing or time slicing in the real world by synchronizing lighting of display items or set portions with the riders'/passengers' eyewear so that different individuals on a single ride are given a different visual experience.

The lighting can be readily synchronized with particular glasses so that one viewer sees one lighting plan while another viewer will "concurrently" (e.g., within a fraction of a second of each other) see an entirely different lighting plan. Each lighting plan may be adapted and operated so as to cause at least some different portions of the set or display items to be illuminated for viewing by the different sets of viewers in the group. Alternatively or in addition, the different lighting plans alter lighting effects such as colors, shadows, depths, and the like so that portions of the scene appear different to different groups of viewers. Lighting, shadows, and color may be controlled in the display system either programmatically or under user control to change the light plan selected for a particular viewer or set of viewers.

In a ride with the display system, for example, riders in the same vehicle could be given differently controlled eyewear (eyewear synchronized to different illumination plans/patterns) to be given vastly or subtly different experiences based on alternative sets of illuminated items that are presented/displayed to different riders. In a museum or similar display setting, lighting could be synchronized with audio such that guests coming upon a display at different times could be seeing and hearing (through headphone audio) entirely different portions of a narrative-supporting set/display based on their time of arrival at the set/display. In an aquarium application (e.g., "ride" and "attraction" can be construed quite broadly), different fish or background features can be highlighted for different viewers at the same time (or nearly the same time via time slicing/time multiplexing control of the eyewear and light sources). As will be appreciated, the display systems (and corresponding methods) described herein can be used to convert many observational displays into story telling opportunities.

Non-entertainment applications include product selection or warehouse scenarios where particular shelves or goods can be selectively highlighted to help users find particular items. For example, a user registers items she is seeking and that information is used to cause shutter glasses or a handheld camera or other device to synchronize with a particular lighting plan among several alternative plans being used to illuminate the space. As a result, when a shopper or store employee turns into an aisle the desired items become quickly identifiable with each guest in the aisle having their own items highlighted. Alternatively, a store may augment a user's list by highlighting store-selected areas having promotional items or items related to things already selected by a particular shopper.

More particularly, a display system is provided for use with amusement park rides and other attractions. The system includes a first light source intermittently illuminating (i.e., flashing light sources (or the outputs) at a determined frequency such that it appears to be continuously on to the viewers that have their eyewear synched to the light source) a first set of items in a physical set and also includes a second light source intermittently illuminating a second set of items in the physical set. The system further includes a first set of optical filters operating in time synchronization with the first light source to pass light from the illuminated first set of items and also includes a second set of optical filters operating in time synchronization with the second light source to pass light from the illuminated second set of items.

In the display system, the optical filters of the first and second sets are shutter glasses or other filters that can be operated at high rates or frequencies to intermittently pass received light (in this case with both shutters/lenses being operated concurrently in a like manner to pass light to both the right and the left eye). The light sources are adapted for high speed control and may be, for example, light emitting diodes (LEDs) adapted for high speed control. During operation of the display system, the first and second light sources are operated in a time multiplexed manner (e.g., the light sources are operated alternately in a rapid manner) such as each being operated at a rate or frequency of at least 50 Hertz (but offset from each other). To facilitate synchronization of the light sources and corresponding ones of the optical filters, the system may further include a controller generating synchronization signals transmitted to the first and second light sources and to the first and second sets of optical filters.

In some implementations, the display system may further include a ride vehicle(s) for receiving viewers wearing the first and second sets of optical filters, and, then, the passenger vehicle is moved along a ride path adjacent the physical set. The controller or user input can be used in the display system to modify an operating state of a number of the first set of optical filters while the passenger vehicle moves along the ride path to cause the number of the first set of optical filters to operate with time synchronization with the second light source (e.g., a user may interact with a ride set to score a preset number of points and, after that time, be automatically switched to a new level or a user may be allowed to switch between viewing the items illuminated only by the first light source and those items only illuminated by the second light source). In the system the first set of items differs at least partially from the second set of items, whereby a viewer using one of the first set of optical filters has a different viewing experience than a viewer using one of the second set of optical filters.

DETAILED DESCRIPTION

Figure 1:
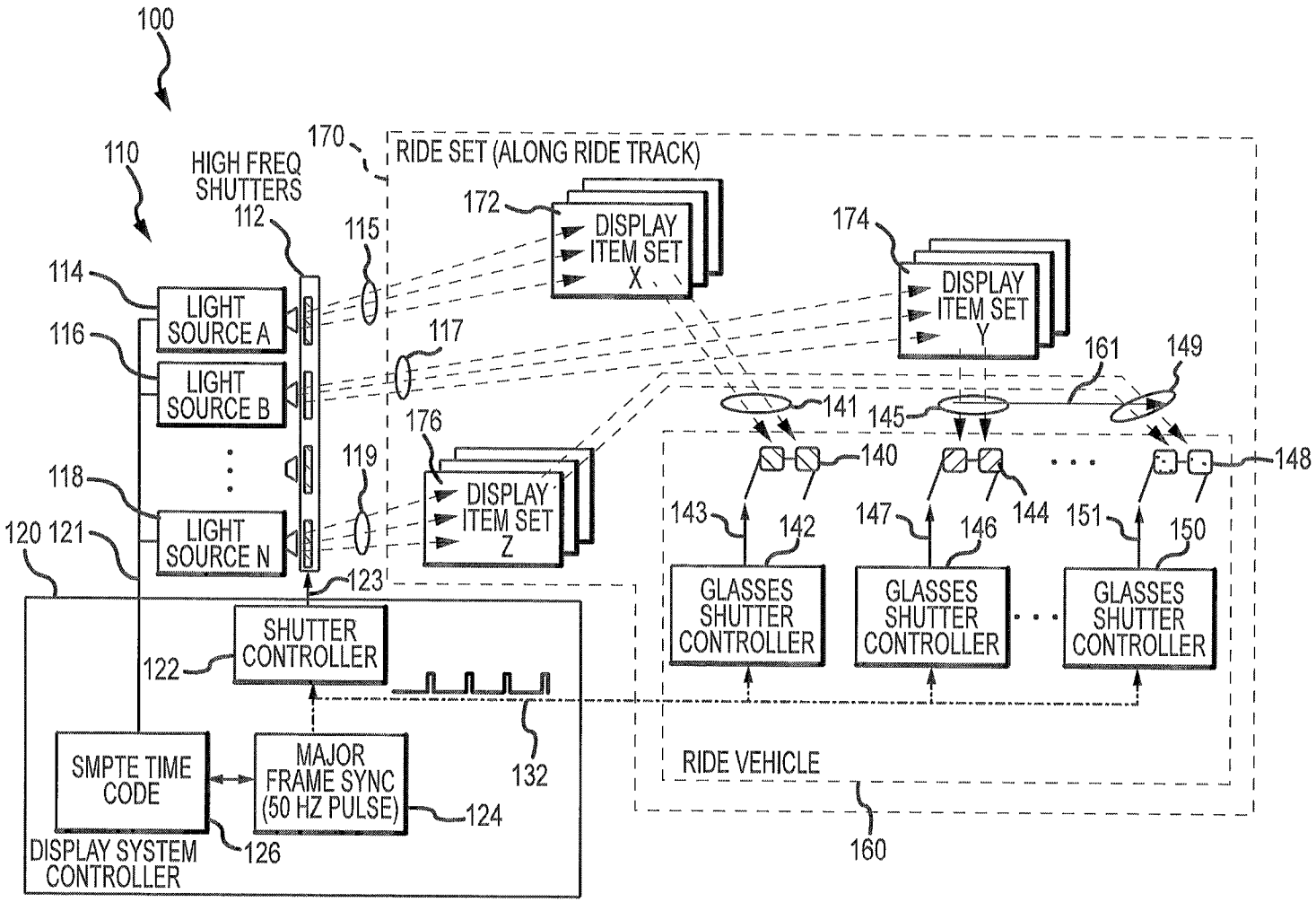
FIG. 1 illustrates a functional block diagram of a display system that may be provided in a ride or attraction or other display setting, with the display system being shown to be used with shutter glasses and shutter-controlled light sources (as one non-limiting example of how light sources may be time synchronized with viewer eyewear)

Briefly, a display system is described herein that is specially adapted to apply the theory of time slicing or time multiplexing of displayed imagery to a real world physical set such as a set along an amusement or theme park ride path (e.g., a path may be defined by a track followed by a ride vehicle or the like). The display system generally includes two or more light sources that are configured to illuminate first and second portions of the real world set (e.g., first and second sets of display items in the ride set) at differing times in a time alternating or time multiplexed manner, with a controller operating these light sources to synchronize their selective projection of light to illuminate the first and second portions of the set.

The display system also includes eyewear provided to viewers, such as passengers in a ride vehicle that is moving through the ride set, and the eyewear is operated to cause a first number of the viewers to see the illuminated first portions of the set and a second number of the viewers to see the illuminated second portions of the set. For example, the controller may time synchronize operation of the eyewear (e.g., shutter glasses) with the operation of the light sources. In brief, selectively illuminated light sources are time synchronized with shutter glasses or other controllable eyewear to allow two (or more) subsets of viewers within a group to view two or more subsets of display items or portions of a real world set while the viewers pass by the set as a group. In this way, each subset of viewers can be provided a different visual experience while on the same ride or in the same attraction.

It should be kept in mind, the system may be used to simply highlight pieces of a physical set without requiring two completely different sets. One spotlight, for instance, could be used to highlight a background character to draw attention to it for some viewers even though it would remain visible to everyone. In this way, some people see the spotlight/highlight. The spotlight could also make some things appear black and white and selectively color objects (e.g., different objects being colored differently for differing viewers). In one case, kids may see a scene with children in color while adults see the same scene but with adults in color. Hence, many of the illustrative systems and their uses teach embodiments in terms of seeing or not seeing set pieces, but it will readily be understood by those skilled in the art that the technology of the systems can be used to highlight objects for different groups of viewers in addition to or instead of making objects selectively visible/invisible to the viewers.

Prior to turning to specific implementations, it may be useful to provide a few examples of how such a display system may be used in practice to provide viewers with unique visual experiences. In one example, a group of people may participate in an amusement park ride and climb into the seats of the ride's vehicles. The group may be divided into two sets labeled Viewers A and Viewers B, and the viewers in the two sets may be interspersed in the vehicles in nearly any manner (e.g., equal number or different number from each of the two sets in each ride vehicle). A first set of eyewear (e.g., shutter glasses) may be provided to those in the Viewers A set, and a second set of eyewear (e.g., shutter glasses) may be provided to those in the Viewers B set. The display system may include two sets of light sources, such as theatrical or set lighting that can be controlled in a high frequency manner (e.g., image forming devices such as projectors with light emitting diodes (LEDs) backlights, DMD switches, or the like), and each set of light sources may be focused upon or targeted toward two different portions or sets of the display items in the set along the ride path. Then, the light sources can have their operations synchronized in time with the operation of either the first or second sets of eyewear such as with radio frequency (RF), infrared (IR) pulses, or other synch signals from the controller. In this way, the members of the Viewers A set may be shown first portions of or items in the ride set or thematic display (e.g., puppies or other friendly animals to children) while the members of the Viewers B set may be shown second portions of or items in the ride set (e.g., ghouls or aliens to teenagers/adults).

In this same or a different implementation, a storyline can be developed for the viewers/passengers of a ride or attraction. For example, a detective or mystery storyline may be created that urges the viewers/passengers to look for or find a number of clues or visual objects in the ride set or attraction display. The riders/passengers may be placed in a Viewers A set the first time they take the ride, and a first set of clues/objects may be selectively illuminated for their viewing in the ride set. The riders/passengers may later be placed in a Viewers B set when they are on their second time on the ride, and a second set of clues/objects may be selectively illuminated by the display system for their viewing in the ride set. In this way, a single set along a ride path/track may be used to sequentially present different items for the passengers/viewers to find or identify to solve a case or mystery. The storyline may be extended over two or more times on a ride as a third (or more) set of light sources may be synchronized with third (or more) set of eyewear. In this way, the riders/passengers are rewarded for multiple rides rather than just taking one ride.

In some embodiments, the assigning of different passengers/riders into differing subsets may be based on language. For example, all Spanish-speaking passengers may be provided shutter glasses that can be synchronized with illumination of light sources to illuminate signage/text in the ride set that is provided in Spanish. Passengers that speak another language such as English, Chinese, Japanese, French, Italian, or another language may be provided different shutter glasses that are synchronized with light sources that are operated to illuminate signage/text in the ride set provide in their language.

In some embodiments, the wearer of the eyewear may be able to select which set of light sources that their eyewear is synchronized with to select which portion of the ride set they can view. For example, shutter or other glasses may be configured to include a switch on the frame (or elsewhere) to cause the glasses to be operated in a time synchronized manner with one of two or more different sets of light sources that are selectively operated over time to illuminate different portions of the ride set or attraction display. This is a user-controlled display system. In other cases, system control may be used to switch the glasses to be synchronized with a different set of light sources. For example, a passenger/rider may be interacting with the ride set (e.g., shooting targets, identifying clues/object, and the like) and earn a score, and, when their score passes a preset level, the system controller may switch their glasses for synchronization with a different set of light sources to allow them to view portions or items of a ride set associated with a new or next level for the ride/attraction. Such system control may be based on numerous parameters such as the viewer's skill level, their recent performance in an interactive setting, user provided preferences (e.g., prefer to view objects/items in the ride set associated with dinosaurs or animals rather than aliens or ghosts), and so on.

FIG. 1 illustrates a display system 100 of one embodiment that is adapted for selectively illuminating items or objects or portions of a set or display to viewers. In this example, a ride vehicle 160 that may be track-based moves as shown with arrow 161 through a ride set 170 with three different sets of display items 172, 174, 176, and these display item sets 172, 174, 176 can be illuminated in a manner with the display system 100 such that each set is only visible to viewers/riders in the ride vehicle wearing eyewear that has its operation synchronized with the illumination of a paired one of the sets 172, 174, or 176.

As shown, the system 100 includes an illumination assembly 110 with a set of three (or more) light sources 114, 116, 118 operating to project or output a set of light streams (or to provide output light) 115, 117, 119. In this non-limiting example, high frequency shutters 112 are provided at the light source outlets/outputs to time multiplex the light streams 115, 117, 119 from the light sources 114, 116, 118 as in the past was done for output streams of projectors to time multiplex image streams. Light source 114 is used to illuminate with stream 115 a first set of display items 172 in the ride set 170, light source 116 is used to illuminate with stream 117 a second, differing (at least partially) set of display items 174 in the ride set 170, and light source 118 is used to illuminate with stream 119 a third set of display items 176 (which differs at least somewhat from the first and second item sets 172, 174). For example, the light sources 114, 116, 118 may be focused or targeted onto the front or back surfaces of the display items 172, 174, 176, respectively, such that when the controller 120 powers via line 121 the light sources 114, 116, 118 and the shutters 112 are controlled as shown at 123 via shutter controller 123, one of the sources at a time will selectively illuminate portions of the ride set 170.

To the naked eye (without glasses 142, 146, 150, the streams 115, 117, 119 may almost appear to be provided concurrently because the rate or frequency (controlled by signal 123 via shutters 112) is such that there is no or little perceptible delay between the streams 115, 117, 119. Three sources are shown in light source assembly 110, but 2 to 6 or more may be used in the assembly 110, and the high frequency shutters 112 may operate at a wide range of frequencies to open and close such as 50 to 300 Hertz (Hz) or more, with 50 Hz shown in FIG. 1 as one exemplary implementation.

The system 100 also includes a system controller 120 that includes a time code module 126 for providing a time code signal to the light sources 114, 116, 118 as shown at 121 such as an SMPTE time code signal to synchronize their operation to output light streams 115, 117, 119, and/or the time code module 126 may be used to generate with a major frame synchronization signal via module 124 such as at 50 Hz or another useful frequency that is used by shutter controller 122 to operate shutters 112 (e.g., shutters 112 may not be used/required in some applications where light sources of assembly 110 can be controlled via signals 121 in a high frequency manner). The controller may be set to a particular frame offset, and a synchronization signal (or timing reference pulse) 132 may be transmitted from the controller 120 to synchronize operation of eyewear such as the illustrated shuttered glasses 142, 146, 150 used by the audience/viewers (not shown) in vehicle 160 via controllers 142, 146, 150 as shown with signals 143, 147, 151.

As shown, the system 100 also includes a plurality of optical filters or eyewear shown as shuttered glasses 140, 144, 148 that are worn by the passengers/viewers (not shown) in the ride vehicle 160 to view one of the sets of display items 172, 174, 176 in the ride set 170 when illuminated by light streams 115, 117, 119 provided by the light sources 114, 116, 118. A glasses shutter controller 142, 146, 150 is optionally provided for each of the glasses 140, and this controller 142, 146, 150 changes (as shown with signals 143, 147, 151) the operating state (e.g., the shuttering frequency of LCD glasses) of the glasses 140, 144, 148 to choose which item set 172, 174, 176 is viewable (e.g., which others are filtered or shuttered out). The controllers 142, 146, 150 may operate in response to a channel selection signal from a channel selector operable by the wearer of the glasses 140, 144, 144 or a channel selector provided in the system controller 120, which may be a wired or wireless device communicatively linked to the glasses controllers 142, 146, 150. The channel selector may be operable remotely via signals from the controller (e.g., based on processing/interpretation of user input or a show control program or the like) and/or based on direct user input (e.g., a person wearing glasses 140, 144, and/or 148 may press a button on a selector to choose a channel or image sets 172, 174, 176 to view via time synchronization with light sources 114, 116, or 118). As shown, the glasses 140, 144, 148 are in three differing operating states allowing vehicle passengers wearing the glasses 140, 144, 148 to view three differing illuminated sets of items 172, 174, 176 "concurrently" (as the vehicle 160 passes 161 through the ride set/display 170).

Glasses 140, 144, 148 may be liquid crystal display (LCD) shutter glasses that are configured with glass lenses with liquid crystal and a polarizing filter that has the property that it becomes dark when voltage is applied but otherwise is transparent. A pair of eyeglasses can be made using this material and then operated to alternately darken one eye or lens and then the other in synchronization with signal 132 to view a particular set of display items 172, 174, 176 illuminated by streams 115, 117, 119 such as to view a portions of the ride set 170 (with both their left and right eyes as the shutters of glasses 140, 144, 148 would typically both be open or closed in a synchronized fashion with sources 114, 116, or 118) being illuminated in an sequentially alternating manner due to operation of light source shutters 112 or via controlled operation with signals 121 from display system controller 120.

When the viewer looks at the ride set through the shuttered eyewear 140, 144, 148, the pair of shutters is synchronized to occlude the unwanted images and transmit the wanted images as shown with arrows 141, 145, 149 showing that each pair of glasses 140, 144, 148 only can view one portion 172, 174, 176 of the set 170 at a time. For example, the glasses 140 may be operable to shutter both lenses in time synchronization with light source 114 providing light stream 115 to illuminate the set of display items 172 to allow viewing as shown with arrows 141 the light reflected from or emanating from the items 172 in the ride set 170. This same viewer wearing glasses 140, though, would not be able to view sets 174 and 176, which are only viewable via glasses 144, 148 as shown with streams 145, 149. In this manner, a single ride set/display 170 may be selectively illuminated with differing light sources 114, 116, 118 that have their operations time synchronized with shutter glasses 140, 144, or 148 so as to provide wearers of such glasses in the vehicle 160 one or three differing visual experiences.

Figure 2:
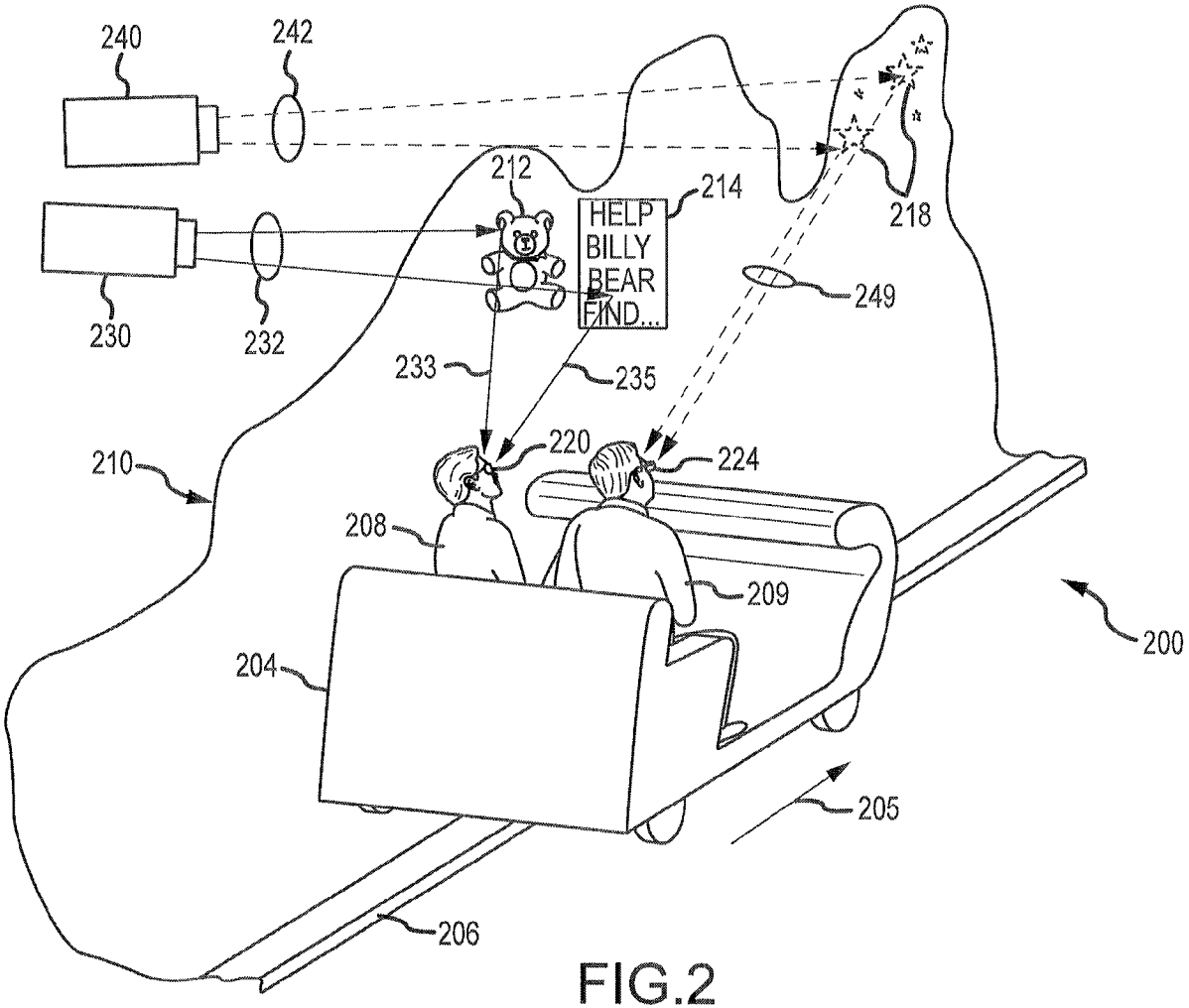
FIG. 2 illustrates a portion of an amusement park ride, shown in simplified and partial form, to show use of a display system of the present description, such as those shown in FIGS. 1 and 3, to selectively illuminate portions of scenery or a thematic set along the path of the park ride.
Figure 3:
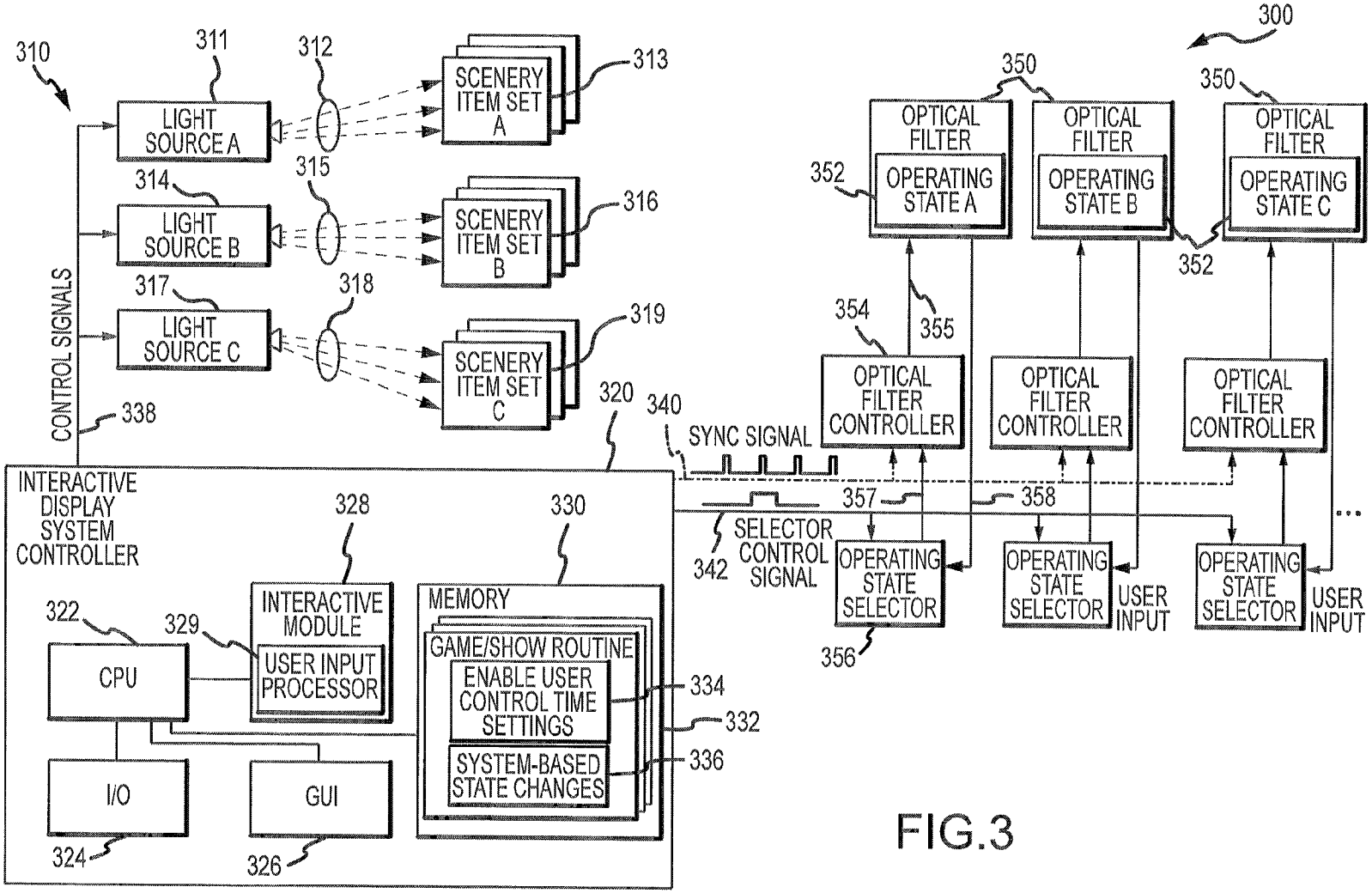
FIG. 3 illustrates another functional block diagram similar to FIG. 1 showing aspects of a display system that may be used in a ride or another attraction to selectively illuminate for viewing sets or portions of a set or a display to wearer's of optical filters adapted to operate in differing operating states to select or filter differing illuminated items in the scenery/set.

FIG. 2 shows a portion of an amusement park ride 200, shown in simplified and partial form, to illustrate use of a display system of the present description, such as those shown in FIGS. 1 and 3, for use in selectively illuminating portions of scenery or a thematic set 210 along the path of the park ride 200. The path of the ride 200 is defined, in this case, by a track 206 upon which a passenger vehicle 204 rides, with travel along the path shown with arrow 205. In the vehicle 204, two passenger (or "viewers") 208, 209 are positioned to move 205 with the vehicle 204 along with the vehicle 204. The ride 200 is configured to provide a visual experience that may be thematic and/or be adapted to provide a storyline. The ride set or scenery 210 adjacent or nearby the track 206 (ride path) of ride 200 may generally be visible to either of the passengers 208, 209 as the vehicle 204 passes by on track 206 as long as it is adequately illuminated.

However, as discussed above, it may be useful to provide display system/assembly in the ride 200 such that while much of the scenery 210 is visible to both passengers 208, 209 in the vehicle 204 portions of the scenery 210 are only selectively illuminated for viewing by a subset of the vehicle passengers 208, 209, e.g., by passenger 208 or by passenger 209 but not both. In this way, a storyline such as a quest to complete (e.g., a treasure hunt) or a mystery to solve can be presented to the ride passengers 208, 209 over two or more trips in the vehicle 204 along the track 204 through the scenery 210. In other words, the passengers 208, 209 may have to pass by the scenery 210 two or more times to view all the "hidden" or selectively illuminated objects/display items in the scenery/ride set 210.

To this end, the display system components provided in the ride 200 include a first optical filter or eyewear (e.g., shutter glasses, color filter glasses, or the like) 220 worn by the first passenger/viewer 208 and a second optical filter or eyewear 224 worn by the second passenger/viewer 209. Both filters/eyewear 220, 224 are configured to intermittently pass light (e.g., at frequency of 50 to 300 Hz or the like) through to the viewers 208, 209, and the timing of the passing of light may be controlled (such as with RF, IR, or other synchronization signal) so as to be synchronized with intermittent (or time slices or time multiplexed) operation of lighting to illuminate portions of the scenery 210.

Specifically, in this example, a first light source 230 is provided that intermittently is operated (e.g., at a frequency of 50 to 300 Hz or the like) to output or project light 232 onto a first display object or scenery/set portion 212 and onto a second display object or scenery/set portion 214. The reflected light (in this case, but back lighting may be used, too) is directed as shown at 233, 235 to the eyewear 220 worn by viewer 208 (and also the eyewear 224 worn by viewer 209), and these eyewear 220 are synchronized with the timing of operation of the source 230 such that the light 233, 235 is passed through for receipt by the eyes of viewer 208 (but not by viewer 209 as the eyewear 224 is operated to block light when light 232 is output by source 230).

Concurrently or nearly so (e.g., in a next time slot or at a second time nearly immediately after the time of operation of source 230), a second light source 240 is operated intermittently (in a multiplexed or alternating manner with source 230) to output or project light 242 that is used to illuminate third display objects or scenery/set portions 218. The reflected light (again, backlighting can be used to provide "illuminating light" for objects in scenery 210) is directed as shown at 247 to the eyewear 224 worn by viewer 208 (and also the eyewear 220 worn by viewer 208), and these eyewear 224 are synchronized with the timing of operation of the source 240 such that the light 247 passes through for receipt by the eyes of viewer 209 (but not by viewer 208 as the eyewear 220 operates to block light when source 240 is operated to output light 242).

In addition to projected lighting, various special effects such as simulated flames, explosions, and lightening are created with lights integrated into a special effect apparatus. A set piece such as a fireplace might display a roaring fire to one viewer and smoldering logs to an adjacent viewer based on which lighting source is selected for each viewer. Lightening might flash outside a window for some viewers while others only see images of the sky in the physical set.

In operation, passenger 208 may be a first time rider and, as such, be provided eyewear 220 synchronized with light source 230 (or sources) to view a first set of display objects such as objects 212, 214. Riders such as passengers 209 on their second ride may be provided eyewear 224 synchronized to operate with light source 240 (or sources) to view a second set of display objects such as objects 218. In other rides 200, third, fourth, or more light sources may be provided and operated in a time sliced or time multiplexed (or wavelength multiplexed) manner with sources 230, 240 to present third, fourth, or more sets of display objects to wearers of third, fourth, or more sets of eyewear time synched (or wavelength matched) with these additional light sources. The assigning of the eyewear to passengers may be random or may be performed based on operator-defined parameters (e.g., how many times have you taken this ride, what is your age group, and so on) or based on user preference (e.g., "choose the purple glasses for a thrill ride or the orange glasses for an adventure with character "X" and so on).

The light 232, 242 is typically targeted onto subsets/portions of the scenery 210 as shown in this example ride 200 so that no passenger 208, 209 sees all of the scenery 210 so that they are encouraged to repeat the ride 200 to get the full visual experience. The targeting or focusing of the light 232, 242 may be achieved by positioning of the light sources 230, 240, by using different output lens with the same or different focusing adjustments, choosing differing brightness for light sources 230, 240, and so on. The light 232, 242 may be white light or may be colored/tinted light to achieve a desired effect. Further, the surfaces of the objects 212, 214, 218 may be varied to achieve a desired effect such as to present a glowing or glittery display item. The light sources 230, 240 may also in some cases be high speed projectors providing a video stream with light 232, 242 to achieve an animation effect with surfaces of the objects 212, 214, 218.

FIG. 3 illustrates another display system 300 (e.g., that may be used in ride 200). The system 300 includes a lighting assembly 310 with: (a) a first light source 311 intermittently operated, via control signals 338 from controller 320, at a first set of times to output light 312 to illuminate a first set of scenery objects or items 313; (b) a second light source 314 intermittently operated, via control signals 338 from controller 320, at a second set of times to output light 314 to illuminate a second set of scenery objects or items 315 (that typically differ at least in part from items in set 313); and (c) a third light source 317 intermittently operated, via control signals 338 from controller 320, at a third set of times to output light 318 to illuminate a third set of scenery objects or items 319 (that typically differ at least in part from items in sets 313 and 316). The operating times, which are set by control signals 338, for the sources 311, 314, 317 are typically alternating and only slightly offset such as with the sources 311, 314, 317 having their operations time sliced or time multiplexed (e.g., operate at frequencies of up to 300 Hz or the like). For example, source 311 is operate at T1 for a short duration, source 314 is operated at a later T2 for a short duration, source 317 is operated at a yet later T3 for a short duration, and this is repeated over and over during operation of the display system 300 to intermittently and repeatedly illuminate scenery item sets 313, 316, 319 with light streams 312, 315, 318.

The system 300 is shown to include a plurality of optical filters 350, which may be worn by different viewers of the scenery sets 313, 316, 319 or be positioned between the viewers and a set/scenery of an attraction. The filters 350 are used to filter all but one stream of light 312, 315, 318 after it illuminates objects such that only one of the scenery item sets 313, 316, 319 is visible through any one of the filters 350 (e.g., depending on which operating state 352 the filter is in to synchronize its operation with one of the sources 311, 314, 317). For example, the optical filters may be glasses/goggles or a helmet shield worn by the audience members (e.g., passengers in vehicles on a ride) or may be provided in other forms such as windows that are shared among two to four or more audience members for viewing an image on a display (e.g., a windshield of a vehicle in a theme ride).

An important factor being that each filter 350 is adapted for having two or more operating states 352 to affect filtering of all but one light stream 312, 315, 318 from illuminated item sets 313, 316, 319 and not necessarily how this filtering is achieved. As noted above, the optical filters 350 may take the form of LCD or other shuttering glasses where both lenses are operated in a like manner (instead of alternating between left and right eye shutters as in prior 3D systems). Alternatively or in addition, color filter glasses are used for the filters 350 and/or polarizing glasses of various configurations may be used for the filters 350. The selection of the optical filters 350 affects the selection of the light sources 311, 314, 317 to support the proper operation, filtering, and then viewing of the illuminated items 313, 316, 319. The light source is selected to pass through one type of filter used by the target glasses and to be blocked by other types of filters used in the non-target glasses. Also, these wavelength and polarization techniques are not based on time multiplexing (although they could possibly do time as well) such that they do not necessarily need the sync signals described in the following description.

The optical filters 350 have their operating states 352 set by control signals or operation of optical filter controllers 354, and the operating states 352 may be the same such that the filters 350 operate to pass light associated with the same set or portion of the scenery 313, 316, 319 to all audience members. In other cases, though, the operating states 352 may differ such that audience members or viewers receive or are shown differing scenery items 313, 316, or 319. Each of the optical filter controllers 354 may receive a time synchronization signal 340 from interactive display system controller 320 and operate to set the channel or operating state 352 (e.g., set which source 311, 314, 317 the filter 350 is time synched with) based on an operating state selection signal 357 received or chosen by the system 320 or an operating state selector 356 based upon user input 358.

The interactive display system controller 320 may be embodied in a number of computers or electronic devices such as a computer device/server with a CPU 322. The CPU 322 controls user input/output devices 324 and optionally provides a graphical user interface (GUI) 326 on a monitor or the like that allows an operator to manually issue selector control signals 342 to change the operating state 352 of one or more of the optical filters 350. More typically, though, the controller 320 acts to transmit a shutter control signal 339 and a synchronization signal 340 to the filter controllers 354 to allow these devices to work to allow the filters 350 to properly allow light from one of the object sets 313, 316, 319 to pass to differing viewers.

An interactive module 328 (e.g., a software program or application) may be provided to facilitate audience interaction with the display system 300 and, in response, to transmit the selector control signals 342. For example, the module 328 may include user input processor 329 to process user input 358 to determine which operating state 352 to place the filters 350. In one exemplary embodiment, the user input 358 involves the audience members pressing a button or moving a switch and the input processor 329 processes this input and responsively selects an operating state 352 to choose a corresponding one of the light sources 311, 314, 317 for synchronizing with operation of the filters 350.

The controller 320 may also include memory 330 storing a game/show/storyline routine 332 that includes time settings for transmitting selector control signals 342 to the operating state selectors 356. In one case, when these signals 342 are sent to a set of selectors 356 the associated audience members may provide user input 358 to choose the operating states 352 (e.g., to change the channel to view a differing one of the "concurrently" illuminated or available illuminated scenery sets 313, 316, 319). In other cases, the game/show routine 332 may be configured to process user input 358 at particular times during transmittal of streams (when control signals 338 are being sent by controllers 320) and then transmit selector control signals 342. For example, audience interaction may be requested (visually or via audio systems (not shown)) at one or more locations along a ride path of a theme park ride. The user input processor 329 may process this input and, in response or based on such processing, choose a particular illuminated object set 313, 316, 319 and send a corresponding selector control signal 342 to the filter controllers 354 (or a subset of such controllers 354).

In some cases, the game/show routine includes a set of system-based state changes 336 that cause particular selector control signals 342 to be transmitted during operation of the light sources 311, 314, 317 (e.g., during a particular display activity or event such as an interactive game) so as to choose a particular object/item set 313, 316, 319 for viewing by the audience members (the same or differing illuminated items for the audience members via filters 350). In this later operating mode, the changes in operating state are not performed in response to user inputs but are performed during the illumination of a particular set of objects 313, 316, or 319 to cause a change by altering operation of the local optical filters 350 and, typically, to cause the viewing experience to differ for at least some of the audience members.

Figure 4:
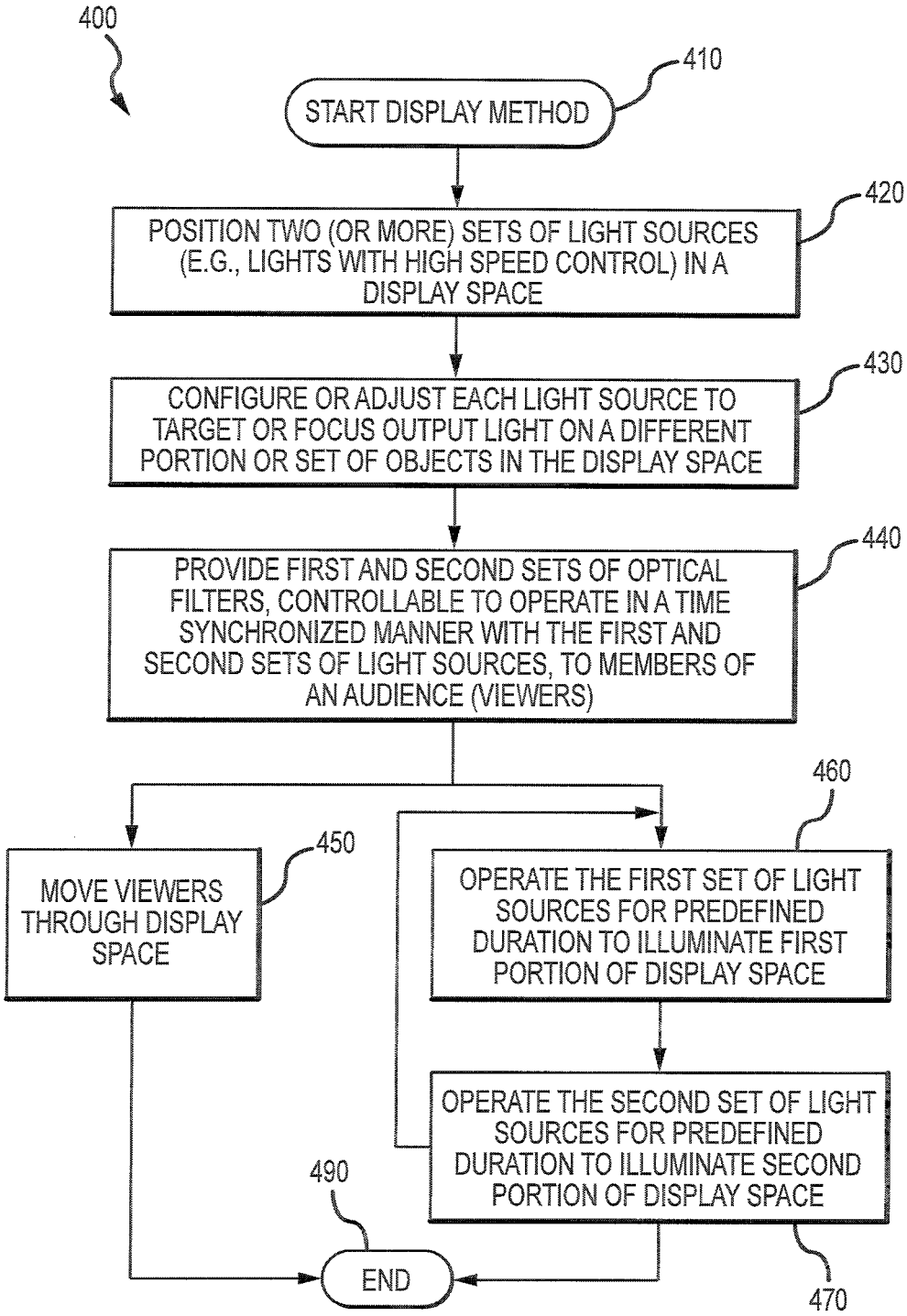
FIG. 4 is a method of providing and operating a display system according to the present description such as for use with the display systems of FIGS. 1 and 3.

FIG. 4 illustrates a display method 400 that may be implemented during operation of the display systems 100 and 300 of FIGS. 1 and 3 and/or the operation of the ride 200 of FIG. 2. As shown, the method 400 starts at 410 such as with planning a desired display effect with or without a storyline that may extend over two or more viewings of a display space (e.g., a thematic set or scenery along an amusement park ride). This planning in step 410 may involve selecting which portions of a ride set/scenery or other display space will be selectively illuminated in two or more sets. Further, the planning in step 410 may involve setting decision parameters for which viewers or audience members will be able to view which sets of the scenery portions or objects or whether this will be a random assignment or will be selectable via user input (e.g., switches on the optical filters that may be operable before or during the viewing experience provided by a display system or user selection of a set of glasses associated with a particular experience).

At step 420, the display method 400 includes positioning two or more sets of light sources within or near a display space. Typically, each set will include one-to-many light sources that are each adapted for high speed control for intermittent output of light streams (e.g., at 50 to 300 Hz or the like), which enables them to be synchronized with shutter glasses or other optical filters (to provide the output light streams in the short time periods in which the glasses/filters allow light to pass). The method 400 continues at step 430 with configuring, adjusting, focusing, and the like each light source so as to target or focus their output light streams onto a predefined portion of the scenery/ride set or onto a number of objects/items in the display space. For example, a first set of light sources may be focused onto a first set of clues while a second set of sources is focused on a second set of clues to facilitate a mystery or treasure hunt-type viewing experience such that viewers may be shown the first set of clues on a first trip through the display space and the second set on the second trip/visit to the display space (while wearing first and then second optical filters such as shutter glasses synched in operation of the first and then second sets of light sources).

At step 440, the method 400 continues with providing first and second sets of optical filters to first and second numbers of an audience or set of viewers (e.g., riders in a train of ride vehicles). Each of the filters (e.g., shutter glasses) in the first set is operated in a time synchronized manner with the operation of the sources in the first set of light sources while the filters in the second set are operated to be synchronized with providing of light by the second set of light sources. As with the light sources, the optical filters are intermittently operable in a high speed manner so as to be synchronized to pass light when the corresponding light sources are being operated (at the same start time and for the same or similar time durations) so that they pass light from a corresponding set of light sources after it has been used to illuminate portions of the display space while blocking light from other, non-corresponding light sources.

The method 400 continues at 450 with placing the viewers wearing or using the optical filters in the display space. More typically, the viewers are moved through the display space over a period of time or at a particular rate, e.g., the viewers are in a passenger vehicle on an amusement park ride and the display space is the set or scenery provided along the ride path. Concurrently, the method 400 involves performance of steps 460 and 470. In step 460, the first set of light sources are operated for a predefined duration (small fraction of a second) to illuminate a first portion of the display space (e.g., first set of objects/items in the scenery of a ride). This operation is halted, and the method 400 continues at 470 with operating the second set of light sources for the predefined duration (again, a small fraction of a second) to illuminate a second portion of the display space (e.g., second set of objects/items in the ride scenery).

The method 400 continues with repeating steps 460 and 470 to intermittently and repeatedly illuminate the first and second portions of the display space while the viewers are present in or are moved through the display space at step 450. Concurrently with steps 450, 460, and 470 the optical filters provided in step 440 are operated to intermittently pass light from the illuminated portions of the display space in a manner that is synchronized with the time multiplexed operation of the two light sources. The method 400 then ends at step 490 (such as with the viewers moving out of the display space). Note, only two sets of light sources and optical filters are used in method 400 but three or more of these components may be used to selectively illuminate and allow viewing of three or more portions of the display space.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. The light sources may take many forms to practice the invention. For example, LEDs may be controlled in a high speed or high frequency manner to be synchronized with shutter glasses. In other cases, the light sources may be high speed projectors. The lighting may be white or may be colored. The lighting effect provided by the light source may be varying levels of brightness or illumination levels for differing display objects/items, may include shimmering and/or glowing light, and/or may include a video effect (e.g., can animate an illuminated item with video projection).

I claim:

1. A display system for use with amusement park rides and other attractions, comprising:

a first light source illuminating a first item in a three-dimensional (3D) physical set;

a second light source illuminating a second item in the 3D physical set, wherein the second item differs from the first item of the 3D physical set;

a first optical filter passing light from the illuminated first item during the illuminating by the first light source and blocking light from the illuminated second item during the illuminated by the second light source; and a second optical filter passing the light from the illuminated second item during the illuminating by the second light source and blocking the light from the first item during the illuminating by the first light source.

2. The display system of claim 1, wherein the optical filters of the first and second sets comprise shutter glasses.

3. The display system of claim 1, wherein the first and second light sources comprise light emitting diodes (LEDs).

4. The display system of claim 3, wherein the first and second light sources each output colored light and are not operable to project video imagery.

5. The display system of claim 1, wherein the first and second light sources are operated in a time multiplexed manner.

6. The display system of claim 5, further comprising a controller generating synchronization signals transmitted to the first and second light sources and to the first and second sets of optical filters.

7. The display system of claim 6, further comprising a ride vehicle for receiving viewers wearing the first and second sets of optical filters and wherein the passenger vehicle is moved along a ride path adjacent the physical set.

8. The display system of claim 1, wherein the optical filters are altered in operation to switch between passing the light from the first illuminated item and the second illuminated item.

9. The display system of claim 1, wherein the first and second light sources operate at a frequency of at least 50 Hertz.

10. The display system of claim 1, wherein the first set of items differs at least partially from the second set of items, whereby a viewer using one of the first set of optical filters has a different viewing experience than a viewer using one of the second set of optical filters.

11. A lighting method for use with an amusement ride, comprising:

illuminating a first portion of scenery provided along a path for the amusement park ride with a first series of light pulses;

illuminating a second portion of the scenery with a second series of light pulses, wherein the second portion is non-planar and differs from the first portion in at least one of location, shape, and size;

moving a passenger vehicle along the path for the amusement ride and past the scenery during the first and second series of light pulses;

operating a first set of optical filters used by a number of passengers in the passenger vehicle to pass light from the first series of light pulses and concurrently operating a second set of optical filters used by a number of passengers in the passenger vehicle to block the light from the first series of light pulses; and operating the second set of optical filters to pass light from the second series of light pulses and concurrently operating the first set of optical filters to block the light from the second series of light pulses.

12. The method of claim 11, wherein the optical filters comprise shutter glasses operable at shuttering frequencies that are synchronized with the first and second illuminating steps.

13. The method of claim 11, wherein at least one of the first illuminating or the second illuminating comprises projecting video content.

14. The method of claim 11, wherein at least one of the first illuminating and the second illuminating comprises illuminating with colored light without video projection.

15. The method of claim 11, wherein the first and second series of light pulses each have a frequency of at least about 50 Hz.

16. A display system for selective illuminating portions of physical scenery along a ride path for an amusement park ride, comprising:

a first light source outputting light onto a first set of surfaces in the physical scenery;

a second light source outputting light onto a second set of surface in the physical set, wherein the first and second light sources are operated in a time multiplexed manner, wherein the first and second sets of surfaces includes a plurality of 3D surfaces, and wherein the first set of surfaces at least partially differs from the second set of surfaces, whereby differing items are illuminated in the physical scenery by operation of the first and second light sources;

a first set of eyewear, worn by a first number of passengers of a vehicle moving by the physical scenery, wherein the first set of eyewear is operated, during the operation of the first light source, to transmit light received from the first set of surfaces in the physical scenery; and a second set of eyewear, worn by a second number of the passengers of the vehicle, wherein the second set of eyewear is operated, during operation of the second light source, to transmit light received from the second set of surface in the physical scenery.

17. The display system of claim 16, wherein the first set of eyewear blocks light during operation of the second light source and wherein the second set of eyewear blocks light during operation of the first light source.

18. The display system of claim 16, further comprising a controller generating synchronization signals to control timing of operation of the first and second sets of eyewear, wherein the eyewear each comprises a pair shutter glasses or a pair of color filter glasses.

19. The display system of claim 18, wherein the controller or user input is used, during the outputting of the light from the first or second light source, to modify an operating state of a number of the first set of eyewear to cause the number of the first set of eyewear to operate with time synchronization with the second light source.

20. The display system of claim 16, wherein the first and second light sources both operate at a frequency of at least 50 Hertz.

* * * * *